US008590812B2

(12) United States Patent
Wurz

(10) Patent No.: US 8,590,812 B2
(45) Date of Patent: Nov. 26, 2013

(54) TWO-SUBSTANCE NOZZLE, CLUSTER NOZZLE AND METHOD FOR THE ATOMIZATION OF FLUIDS

(76) Inventor: Dieter Wurz, Baden-Baden (DE)

( * ) Notice: Subject to any disclaimer, the term of this patent is extended or adjusted under 35 U.S.C. 154(b) by 990 days.

(21) Appl. No.: 12/590,527

(22) Filed: Nov. 10, 2009

(65) Prior Publication Data

US 2010/0116900 A1 May 13, 2010

(30) Foreign Application Priority Data

Nov. 11, 2008 (DE) ..... 10 2008 056 784
Aug. 10, 2009 (DE) ..... 10 2009 037 828

(51) Int. Cl.
*F23D 11/16* (2006.01)

(52) U.S. Cl.
USPC ..... 239/419; 239/424; 239/432; 239/433

(58) Field of Classification Search
USPC ..... 239/419, 419.3, 422, 423, 424, 424.5, 239/428, 429, 432, 433, 500
See application file for complete search history.

(56) References Cited

U.S. PATENT DOCUMENTS

| | | | | |
|---|---|---|---|---|
| 500,005 | A * | 6/1893 | Jones | 417/406 |
| 657,579 | A * | 9/1900 | White | 431/174 |
| 5,678,766 | A | 10/1997 | Peck et al. | |
| 5,782,626 | A | 7/1998 | Joos et al. | |
| 6,863,228 | B2 | 3/2005 | Mao et al. | |
| 6,969,014 | B2 | 11/2005 | Bauer et al. | |
| 2004/0061001 | A1 | 4/2004 | Mao et al. | |
| 2004/0262429 | A1 | 12/2004 | Bauer et al. | |
| 2010/0163647 | A1 | 7/2010 | Wurz | |
| 2010/0219268 | A1 | 9/2010 | Wurz | |

FOREIGN PATENT DOCUMENTS

| | | | |
|---|---|---|---|
| DE | 295 19 351 | U1 | 3/1996 |
| DE | 10319582 | A1 | 12/2004 |
| DE | 10 2007 034 549 | A1 | 1/2009 |
| EP | 0 769 655 | A2 | 4/1997 |
| EP | 1 402 956 | A2 | 3/2004 |
| WO | WO 2007098865 | A1 | 9/2007 |
| WO | WO 2009036947 | A1 | 3/2009 |

OTHER PUBLICATIONS

Office Action of German Patent Office dated Aug. 26, 2010 (4 pages) with English translation of an excerpt (1 page).

* cited by examiner

*Primary Examiner* — Christopher Kim
(74) *Attorney, Agent, or Firm* — Flynn, Thiel, Boutell & Tanis, P.C.

(57) ABSTRACT

A two-substance nozzle with a nozzle housing, the nozzle housing comprising at least one fluid inlet for fluid that is to be atomized, a second fluid inlet for gaseous fluid, a mixing chamber, a nozzle outlet opening and an annular gap opening surrounding the nozzle outlet opening, whereby, within the nozzle housing, means are provided for generating a film of fluid that is to be atomized on a wall in the mixing chamber, and inlet openings are provided for injecting gaseous fluid into the mixing chamber. The inlet openings and the mixing chamber are aligned and configured in a manner so as to inject the gaseous fluid essentially parallel to the wall in the mixing chamber and to move the stream of gaseous fluid within the mixing chamber essentially parallel past the wall.

15 Claims, 9 Drawing Sheets

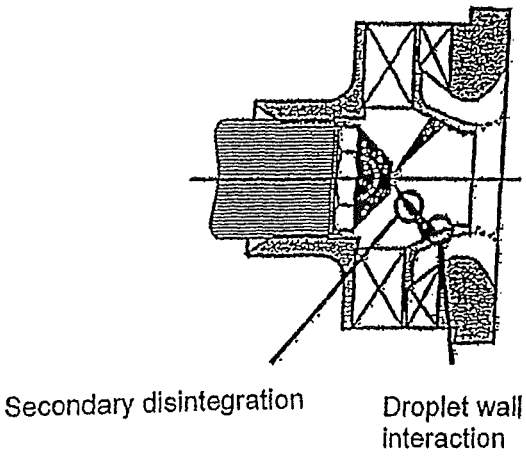
Fig. 1: Prefilming atomizer according to Joos et al. (1993)
Prior Art
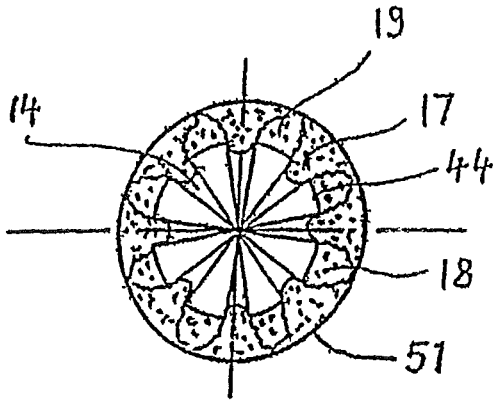
Fig. 3

38

TWO-SUBSTANCE NOZZLE, CLUSTER NOZZLE AND METHOD FOR THE ATOMIZATION OF FLUIDS

FIELD OF THE INVENTION

The invention relates to a two-substance nozzle with a nozzle housing, said nozzle housing comprising at least a first fluid inlet for fluid that is to be atomized, a second fluid inlet for gaseous fluid, a mixing chamber, a nozzle outlet opening and an annular gap opening surrounding the nozzle outlet opening, whereby, within the nozzle housing, means are provided for generating a film of fluid that is to be atomized on a wall in the mixing chamber, and inlet openings are provided for injecting gaseous fluid into the mixing chamber. The invention also relates to a cluster nozzle comprising at least two two-substance nozzles in accordance with the invention, as well as a method for the atomization of fluids by means of a two-substance nozzle.

BACKGROUND OF THE INVENTION

In many process engineering facilities, fluids are injected into a gaseous fluid, e.g., into flue gas that is to be cleaned or cooled. In so doing, it is often highly important that the fluid be atomized in the smallest possible droplets. The smaller the droplets, the larger the specific droplet surface. In process engineering, this can result in significant advantages. For example, the size of the reaction container and the costs for its manufacture depend decisively on the average droplet size. However, in many cases it is by no means sufficient if the average particle size drops below a specified limiting value. Only a few substantially larger droplets can result in considerable disruptions of operation. This is the case, in particular, when the droplets—due to their size—do not evaporate rapidly enough, so that the droplets or even pasty particles are deposited in subsequent components, e.g., on fabric filter tubing or on blower blades, thus leading to malfunctions due to incrustations, corrosion or imbalance.

When fluids are to be atomized to form the finest-possible droplet spray, so-called pressurized gas assisted two-substance nozzles are frequently used in addition to high-pressure single-substance nozzles that are loaded only with the fluid that is to be atomized. In these nozzles, the fluid is sprayed with the assistance of a pressurized gas, e.g., pressurized air or pressurized steam, said pressurized gas forming the first gaseous fluid, into a second gaseous fluid, e.g. flue gas.

In order to simplify the language used, the first gaseous fluid is frequently referred to as the "pressurized air", even though—in generalized terms—it would be possible to refer to pressurized gas or pressurized steam. Further, as a rule, the second gaseous fluid is referred to as the flue gas.

Depending on prior art that exists concerning the respective applications, a multitude of different two-substance nozzles are available. An important criterion considering the field of use is the composition of the fluid that is to be atomized.

1. Nozzles for the Atomization of Fluids that are Free of Solids.

Relatively easy constraints exist only when the fluid does not contain any suspended matter and when the fluid does not form any solid evaporation residues. This applies, e.g., to nozzles for the atomization of ammonia water in systems for the reduction of nitrogen oxide in flue gas, or to nozzles for the atomization of kerosene in turbine jet engines. In particular, for the last-mentioned case of use, so-called prefilming nozzles were developed, such as are shown in FIG. 1. FIG. 1 has been taken from Joos, F., Simon, B., Glaeser, B., Donnerhack, S. (1993): Combuster Development for Advanced Helicopter Engines, MTU FOCUS 1/93. In the nozzle type shown by said FIG. 1, the fluid is injected in the form of thin kerosene jets through small bores against the interior wall of the nozzle and forms a fluid film there. The atomizing air flows between two adjacent fluid jets and forms a core air flow. Due to the shearing stress effect of this core air flow, the fluid film on the wall is driven toward the nozzle orifice. In turbine jet engines only a relatively low pressure ratio is available for the generation of the core air flow. Therefore, in these cases, it is nowhere near possible to reach the velocity of sound during atomization. Also, such known prefilming nozzles are not designed as Laval nozzles with convergent-divergent channel configuration. The known prefilming nozzles are in no way whatsoever suitable for use in process environments in industrial plants, for example, for flue gas cleaning.

2. Nozzles for the Atomization of Fluids Containing Solids.

In many cases the fluid is loaded with suspended matter, e.g., with large or small particles. The small particles may be suspended substances that are carried along—corresponding to the mesh size of a filter—as a residual solids load in the fluid to be atomized. Larger particles, usually having the shape of platelets, are formed by fragments detaching from wall deposits in the feed lines to the nozzle. The wall deposits may be fine particle deposits as well as deposits formed by substances that are initially still dissolved in the fluid. In the case of these applications, narrow channels or bores are avoided because they would become rapidly clogged by suspended matter and/or detached coarse particles carried along in the fluid. Furthermore, care is taken that the fluid does not already evaporate inside the nozzle to such an extent that a rapid buildup of deposits of the exhaust steam residue will occur there.

If the cross-sections for the fluid feed-line in the nozzle are too large, great difficulty exists in separating the massive fluid jet into fine droplets. This requires disproportionately much pressurized air, and the energy consumption of such nozzles is accordingly high.

SUMMARY OF THE INVENTION

The invention is to provide a two-substance nozzle, a cluster nozzle and a method for atomizing fluids, which can be used to achieve a uniform droplet size and which are characterized by low energy consumption.

To achieve this, the invention provides a two-substance nozzle with a nozzle housing, said nozzle housing comprising at least a first fluid inlet for fluid that is to be atomized, a second fluid inlet for gaseous fluid, a mixing chamber, a nozzle outlet opening and an annular gap opening surrounding the nozzle outlet opening, whereby, within the nozzle housing, means are provided for generating a film of fluid that is to be atomized on a wall in the mixing chamber, and inlet openings are provided for injecting gaseous fluid into the mixing chamber, whereby the inlet opening and the mixing chamber are aligned and designed in a manner so as to inject the gaseous fluid essentially in parallel alignment with the wall into the mixing chamber and to conduct the gaseous fluid inside the mixing chamber essentially in a parallel manner past the wall.

In the nozzle in accordance with the invention, a film of atomized fluid is generated on a wall in the mixing chamber, whereby the mixing chamber extends from the inlet openings for the fluid that is to be atomized to the nozzle outlet opening. By aligning and configuring the inlet openings and the mixing chamber in order to inject the gaseous fluid in essentially parallel alignment with the wall, it is possible to minimize the pressure losses in the gaseous fluid. Then, the gaseous fluid—advantageously, in the form of a high-velocity gas stream—is conducted, inside the mixing chamber, past the wall in essentially parallel alignment with said wall, thereby also resulting in a very low energy demand by the nozzle. For example, the two-substance nozzle in accordance with the invention can be operated at a very low pressurized air pressure of less than 1 bar overpressure, and still an extremely small and, at the same time, uniformly distributed droplet size is achieved. The gas stream of the gaseous fluid drives the film of fluid to be atomized, said film being on the wall in the mixing chamber, up to the nozzle outlet opening. There, this fluid film is drawn out into individual lamellae that are then arranged between the gas stream exiting from the nozzle opening and the annular gap stream exiting from the annular gap opening, and are thus atomized into fine droplets. It is also possible for fine droplets to be already generated inside the mixing chamber itself, in that the fluid film driven by the gas stream in the direction of the nozzle outlet becomes instable, and in that, at this point, a partial atomization occurs before the nozzle outlet opening is reached. The two-substance nozzle in accordance with the invention is characterized by an extremely good part-load behavior. With small water streams that are to be atomized, it is possible to work with air at low pressure, for example 0.2 bar overpressure, in particular when an extremely fine atomization is not desired. The flow rates within the nozzle may be relatively low and, for example, amount to 50 m/s at the entry of the mixing chamber and no more than approximately 100 m/s at the nozzle orifice. If small fluid streams are to be atomized in an extremely fine manner or if large fluid streams are to be atomized in a fine manner, higher flow rates are required. This also applies to vapor-assisted atomization. In this case, the velocity of sound is approximately reached—in two-phase flow—at the nozzle orifice of the inventive two-substance nozzle. However, the mixing chamber can also be configured as a Laval nozzle, where the velocity of sound is reached at a smallest cross-section and where the flow cross-section then widens again in order to maintain the flow rate above the velocity of sound. Overall, the two-substance nozzle in accordance with the invention has usefully achieved very low energy consumption with small drop size and uniform drop spectrum.

Advantageously, there are at least three inlet openings for injecting gaseous fluid into the mixing chamber. The inlet openings can be implemented as bores in a ring, for example. The pressurized air jets exiting from the bores run so as to be essentially tangential to the mixing chamber wall and are additionally inclined toward the nozzle axis.

In a further development of the invention, the inlet openings for gaseous fluid in the mixing chamber are aligned at an angle between 0° and 30° relative to the wall in the first third of the length of the mixing chamber.

If the gaseous fluid is injected into the mixing chamber at an angle between 0° and 30° relative to the wall, only a minimal loss of pressure occurs, and the fluid film on the wall of the mixing chamber can still be reliably driven in the direction of the nozzle outlet opening. For example, the mixing chamber can be configured in such a manner that the air is injected in the mixing chamber parallel to the wall, and then, in a second section of the mixing chamber, impinges on the wall at a small angle of less than 30°. As a result of this, the shearing stress effect on the fluid film increases so as to drive said fluid film farther in the direction of the nozzle outlet.

In a further development of the invention, the central axes of the inlet openings for the gaseous fluid are inclined relative to a central longitudinal axis of the mixing chamber in such a manner that the central axes of the inlet openings converge toward the central longitudinal axis of the mixing chamber—viewed in the direction of flow.

In this manner, the formation of zones displaying low gas velocity, i.e., displaying a comparatively slower core air flow, can be prevented and uniform droplet sizes can be ensured. The central axes can be inclined by an angle within the range of 10° to 30° relative to the central longitudinal axis.

In a further development of the invention, the central axes of the inlet openings for the gaseous fluid do not intersect the central longitudinal axis of the mixing chamber.

When the central axes of the inlet openings are arranged skewed relative to the central longitudinal axis of the mixing chamber, said central axes can run toward the central longitudinal axis of the mixing chamber, without, however, intersecting the central longitudinal axis or each other. As a result of this, pressure losses caused by vertical zones are prevented. In the skewed arrangement, the central axes of the inlet openings are inclined by the angle $\gamma$ relative to the central longitudinal axis and by the angle $\delta$ in circumferential direction, whereby angle $\delta$ is preferably within a range of 5° to 15°.

In a further development of the invention, the central axes of the inlet openings are located on the lateral surface of an imagined rotation hyperboloid.

In this manner, the gaseous fluid inside the mixing chamber can be imparted with a twist that promotes the atomization into fine droplets. The central axes of the inlet openings can then be the generatrices of a single-shell hyperboloid.

In a further development of the invention, the mixing chamber also contains droplet loading means for loading the high-velocity gas stream with fluid droplets at least in the regions remote from the wall with the fluid film, said regions not being decelerated by the friction between the fluid film and the high-velocity gas stream.

In this manner, it can be ensured that the injected gaseous fluid is decelerated in each region and thus performs its function, be it to tear the fluid to be atomized into individual droplets, be it to drive the fluid film on the wall of the mixing chamber in the direction of the nozzle exit. Specifically, the formation of a core air flow is prevented, which core air flow—compared with the air stream flowing along the wall in the mixing chamber—is not decelerated or only slightly decelerated and thus leaves the nozzle again, without performing any work.

In a further development of the invention, the droplet loading means comprise a central pin, whereby one inlet opening for the fluid to be atomized is directed at a tip of the central pin and the central pin—starting at the tip and ending at a point of maximum diameter—widens in a cone-like manner, whereby the gaseous fluid is conducted inside the mixing chamber past the point of maximum diameter of the central pin.

With the use of such a central pin, it is possible to separate the fluid to be atomized into a thin fluid film or into individual fluid jets, for example, by means of furrows or channels in the central pin, in which case the energy required therefor is provided by the kinetic energy of the fluid that is to be atomized. The fluid to be atomized leaves the central pin at a point of maximum diameter, where the fluid to be atomized is caught by the gaseous fluid, partially separated into individual droplets and then carried along in the direction of the nozzle outlet and partially impinges on the wall of the mixing chamber in order to form a fluid film. With the use of such a central pin, it is also possible to load the regions of the air flow that are remote from the wall of the mixing chamber with droplets, whereby said air flow can be decelerated and thus contribute to the atomization. The central pin with its suspension device, and/or the nozzle housing defining the mixing chamber, can be made of hard metal or of silicon carbide.

In a further development, the means for generating a film of the fluid that is to be atomized comprise at least one obstacle in the flow path of the fluid to be atomized in order to divide the fluid to be atomized by means of its flow energy into partial streams. Advantageously, the means for generating a film include a twist insert upstream of the fluid inlet into the mixing chamber.

With the use of a twist insert in the flow path of the fluid to be atomized, it is possible to cause the fluid to be atomized to rotate, so that most of said fluid will move along the wall of a flow channel and then can also generate the desired fluid film on the wall of the mixing chamber. An obstacle in the fluid path of the fluid supply can also have the form of at least three channels or furrows that are open toward the central longitudinal axis of the nozzle, said channel or furrows extending like the lands and grooves in a gun barrel.

In a further development of the invention, the means for generating a film of fluid to be atomized comprise a central pin, whereby the inlet opening for the fluid to be atomized is directed at a tip of the central pin, and the central pin initially widens in a cone-like manner starting at the tip.

Consequently, a central pin can perform two functions, namely, on the one hand it can load a core air stream with droplets and, on the other hand, it can generate a film of fluid to be atomized on the wall of the mixing chamber. The fluid that is to be atomized and has been separated leaves the central pin at the point of maximum diameter, is then partially torn into droplets by the core air flow and carried along, and part of said fluid reaches the wall of the mixing chamber at the point of maximum diameter located approximately opposite said wall, and forms the desired fluid film on said wall.

In a further development of the invention, the central pin—viewed in the direction of flow—has a tapering trailing body downstream of a region of maximum diameter.

By means of such a trailing body, for example, in the manner of a tadpole tail, it is possible to prevent a vertical zone and dead zone downstream of the central pin where larger droplets could form. In addition, the tapering trailing body can also ensure that the flow rate of the gaseous fluid in the mixing chamber is maintained at a high level.

In a further development of the invention, the central pin has the shape of a double cone.

In a further development of the invention, the wall in the mixing chamber is arranged so as to be essentially parallel to the tapering trailing body of the central pin.

For example, the central pin has the shape of a circular cone and has the shape of a double cone and is surrounded by the wall of the mixing chamber at a constant distance. As a result of this, the annular gap width can be kept constant; due to the taper of the central pin and the wall of the mixing chamber, the free cross-section of the flow is reduced.

By reducing the free cross-section of the flow of the mixing chamber—viewed in the direction of flow along the trailing body of the central pin—the velocity of the gas flow in the mixing chamber can be maintained at a high level, and a fluid film on the trailing body as well as on the wall of the mixing chamber is subject to a high shearing stress.

In a further development of the invention, the central axes of the inlet openings for the gaseous fluid into the mixing chamber are arranged so as to be essentially parallel to the outside wall of the trailing body of the central pin.

In this manner, the gaseous fluid can be injected into the mixing chamber with an extremely small loss of pressure, and it is possible to achieve a high velocity of the gaseous fluid in the mixing chamber even at low input pressures of the gaseous medium.

In a further development of the invention, a central pin has the shape of a double cone, whereby the region with minimum cross-section of the mixing chamber is arranged on the level of the down-stream tip of the double cone.

In a further development of the invention, a cross-section of the mixing chamber tapers initially, and maintains or enlarges said cross-section in an adjoining region of minimal cross-section.

In this manner, a high-velocity gas flow can be maintained or even accelerated when the velocity of sound is reached in the region of minimal cross-section.

In a further development of the invention, the mixing chamber tapers in the form of a hollow truncated cone and widens again, starting from a point of minimum cross-section in the form of another hollow truncated cone, whereby the central axes of the inlet openings for the gaseous fluid are aligned in the mixing chamber parallel to the inside wall of the mixing chamber in the tapering hollow truncated cone.

In this manner, the gaseous fluid is injected in the tapering region parallel to the wall of the mixing chamber, on which the fluid film is driven along. In the widening region, the gaseous fluid is then also conducted parallel to the wall of the mixing chamber or at a small angle relative to the wall of the mixing chamber. In this arrangement, a small angle may be advantageous in order to increase the action of a shearing stress on the fluid film and to drive said fluid film in the direction of the nozzle outlet.

In a further development of the invention, the means for generating a film of fluid to be atomized comprise a central pin, whereby an inlet opening for the fluid to be atomized is directed against the tip of the central pin, and the central pin is provided, in the region of its flow approach side for the fluid to be atomized, with at least two channels or furrows that extend from one tip of the central pin to a point of largest diameter of the central pin.

By means of such channels or furrows, it is possible to divide the fluid to be atomized and impinging on the tip of the central pin, at least partially, into individual jets using only the kinetic energy of the impinging fluid. These jets then leave the central pin at the point of greatest diameter, are caught by the gaseous fluid injected into the mixing chamber and are partially torn into droplets. The fluid jets leaving the central pin ensure, on the one hand, that a core air flow is loaded with droplets, decelerated and will not tunnel through the nozzle without performing its atomizing function. In addition, the fluid jets impinge on the wall of the mixing chamber, said wall being approximately opposite the point of maximum diameter of the central pin and ensure there the formation of a fluid film on said wall, said fluid film then being driven—by the gaseous fluid injected into the mixing chamber—in the direction of the nozzle outlet. The channels or grooves may extend on the generatrices of the central pin or be inclined with respect to them.

In a further development of the invention, the means for generating a film of fluid to be atomized comprise a central pin, whereby the inlet opening for the fluid to be atomized is directed against a tip of the central pin, and the central pin is connected—via at least two radially extending strips—with the nozzle housing defining an inside wall of the mixing chamber.

Such an arrangement of the central pin is simple from the viewpoint of construction, promotes flow, and, as a result, the central pin is also exchangeable. Such an exchange of the central pin may be necessary in case of wear or also if a nozzle is to be adapted to a different fluid to be atomized or to different pressure conditions.

In a further development of the invention, the annular gap opening surrounding the nozzle outlet opening is provided between the nozzle housing defining an inside wall of the mixing chamber and an annular gap pipe, whereby—upstream of the annular gap opening—a twist body is arranged between the nozzle housing and the annular gap pipe.

By means of such a twist body, it is possible, on one hand, to impart the annular gap air with a rotation that promotes the most thorough possible atomization at the annular gap opening. In addition, this twist body can ensure an extremely precise annular gap width. This applies, in particular, when the twist body is arranged, close to the annular gap opening, between the annular gap pipe and the nozzle housing. Such a twist body can be designed in a simple manner, for example, in that a disk is provided with several circumferential notches.

In a further development of the invention, a veil-of-air nozzle is provided, said nozzle at least partially surrounding the annular gap opening.

By providing a veil-of-air nozzle, it is possible to prevent a coating from forming on the outside skin of the spray lance and, in particular, also in the region of the nozzle orifice. Such deposits can come from the process environment into which material is sprayed. The veil of air can be heated to such a degree that the temperature will not fall below the dew point at the outside skin of the lance.

The object to be achieved by the invention is also achieved by a cluster nozzle for the atomization of fluids, said cluster nozzle comprising at least two two-substance nozzles in accordance with the invention.

The combination of several inventive two-substance nozzles to form a cluster nozzle provides the possibility of atomizing even large fluid amounts into small droplets, at the same time requiring only a minimum of energy.

The object to be achieved with the invention is also achieved with a method for the atomization of fluids by means of one two-substance nozzle having at least one fluid inlet for gaseous fluid and at least one fluid inlet for the fluid to be atomized, as well as a mixing chamber, said method comprising the following steps:

- Generating a film of fluid to be atomized on a wall in the mixing chamber;
- Generating a stream of gaseous fluid inside the mixing chamber, and passing the gaseous stream essentially parallel past the fluid film inside the mixing chamber;
- Generating an annular gap stream of gaseous fluid on an annular gap opening downstream of the mixing chamber; and
- Atomizing the film on the annular gap opening.

With the method in accordance with the invention, it is possible to atomize a fluid and, in so doing, achieve not only very tiny droplet sizes but also a highly uniform distribution of droplet sizes. Specifically, it can also be ensured with the method in accordance with the invention that there are no individual large drops in the generated spectrum of droplets that could create problems due to fluid deposition during subsequent process steps. The film of fluid to be atomized on a wall of the mixing chamber is driven in the direction of a nozzle outlet opening by the gaseous stream that is being moved parallel to the wall. At the same time, however, the fluid film can already be partially divided into individual droplets. At the nozzle outlet opening, the fluid film is then drawn out into individual fluid lamellae that are received between the annular gap flow and the air flow from the nozzle outlet opening and are thus reliably atomized into very fine droplets. With the use of the method in accordance with the invention, it is also possible to atomize fluid in a very energy-saving manner, because the film of fluid to be atomized can be generated by means of the kinetic energy of the fluid that is to be atomized and is supplied to the nozzle. The gaseous fluid is moved past the fluid film in the mixing chamber in an essentially parallel manner and, as a result of this, experiences only a minimal loss of pressure. This makes it possible even to work at air pressures of less than one bar overpressure and still achieve small droplets and a uniform droplet size distribution.

In a further development of the invention, the additional step is provided of loading the stream of gaseous fluid with droplets of the fluid to be atomized inside the mixing chamber at least in regions that are remote from the wall with the film of the fluid to be atomized.

In this manner, it can be prevented that part of the gaseous fluid flows through the nozzle without performing any work. Instead, the gaseous fluid is also decelerated in regions that are remote from the wall and thus, at the same time, already performs part of the atomizing function.

In a further development of the invention, a stream of fluid to be atomized is divided into partial streams by means of the flow energy of the stream of fluid that is to be atomized.

In this manner, it is possible, for example, to generate fluid jets only by means of the kinetic energy of the fluid to be atomized, said jets then being partially divided by the gaseous air into droplets and partially forming the fluid film on the wall of the mixing chamber. Consequently, energy demand in the nozzle can be kept very low.

In a further development of the invention, the method in accordance with the invention is provided for generating a veil-of-air stream of gaseous fluid, said veil-of-air stream partially surrounding the annular gap air stream at least directly downstream of the annular gap opening. The veil-of-air stream can be heated.

By generating a veil-of-air stream, it is possible to prevent deposits on the outside skin of the nozzle lance and, in particular, in the region of the nozzle orifice.

BRIEF DESCRIPTION OF THE DRAWINGS

Additional features and advantages of the invention are obvious from the claims and the description of preferred embodiments of the invention hereinafter in conjunction with the drawings. Individual features of different described embodiments can be combined with each other in any manner without surpassing the frame and scope of the invention.

FIG. 1 is a longitudinal section of a prefilming nozzle in accordance with prior art for the atomization of aviation fuel.

FIG. 3 is a view of the cutting plane A-B of FIG. 2, whereby only the central pin and the oppositely located inside wall in the mixing chamber are shown.

DETAILED DESCRIPTION

Figure 2:
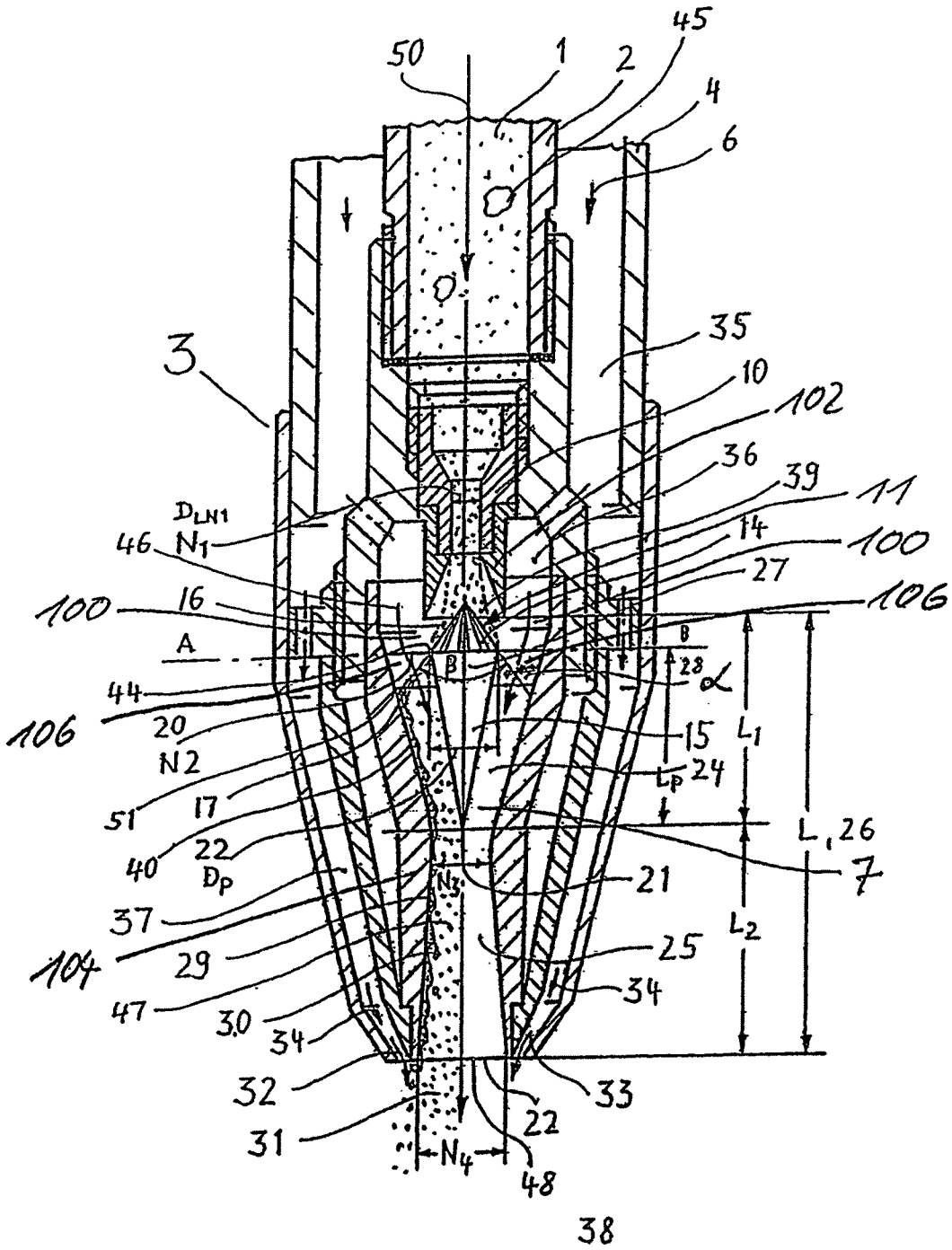
FIG. 2 is a longitudinal section of an inventive two-substance nozzle in accordance with a first embodiment, comprising a central pin with a furrow structure on the inflow side and a slimly tapering tail.

FIG. 2 shows a longitudinal section of an inventive two-substance nozzle in accordance with a first embodiment of the invention, whereby a central pin 11 is not shown in section. In the inventive two-substance nozzle, the central pin 11 is designed in such a manner that the fluid does not leave the pin edge 44 as a peripherally closed lamella with approximately constant layer thickness but, predominantly, in individual and relatively massive jets 17 that cannot be prevented by the peripherally homogeneous air flow 46 from reaching the mixing chamber wall 51 of the two-substance nozzle. Rather, the air flow can pass between the fluid jets 17 and forms a core air jet 47 that is only minimally loaded with droplets, while a large percentage of the fluid flows as the film 29 via the mixing chamber wall 40 to the nozzle orifice. At the nozzle orifice 48, this fluid film 29 is drawn out into a thin lamella under the influence of an outer annular gap air flow 32 and 34 and the core air flow 47, said lamella disintegrating into small droplets. To avoid confusion, the core air flow 47 and the fluid film 29 are shown only to the left of the central axis 50.

First, an essential aspect of the invention is that the fluid is divided into the partial jets 17 by means of the central pin 11 by using the kinetic energy of the fluid to be atomized and that then, by means of the jets 17 impinging on the wall 40 of the mixing chamber 7, a fluid film 29 is formed on the walls of the mixing chamber 7. This fluid film 29, however, is naturally formed on the entire inside wall of the mixing chamber 7 that surrounds the central pin 11.

A gaseous fluid, usually pressurized air, enters the mixing chamber 7 through inlet openings 100 that are defined between the central fluid outlet 102 and the inside wall of the mixing chamber 7. The mixing chamber 7 extends from the inlet openings 100 to a nozzle outlet opening 48. The mixing chamber 7 is arranged inside a nozzle housing 104. The inlet openings 100 are aligned and arranged in such a manner that they move the gaseous fluid into the mixing chamber 7 parallel to the wall 40. The mixing chamber 7 comprises a first section having the length L1 in which it tapers in the form of a hollow cone. In a second section having the length L2, first a point having the smallest diameter $N_3$ is passed, whereby, subsequently at this point, the mixing chamber 7 again widens in the form of a hollow truncated cone until the mixing chamber 7 ends at the nozzle mount or the nozzle outlet opening 22. Still outside the nozzle, further mixing takes place downstream of the nozzle orifice; however, this section is no longer referred to as the mixing chamber of the nozzle. The central axes of the inlet openings 100 are thus aligned parallel to the wall 40 in section L1 of the mixing chamber and are aligned at a small angle of less than 30° with respect to the wall in section L2 of the mixing chamber, this corresponding to the unequal opening angles of the hollow double cone in the sections L1 and L2. Due to frictional forces, the gaseous fluid entering into the mixing chamber 7 drives the fluid film 29 that has formed on the wall of the mixing chamber in the direction of the nozzle orifice 48. A part of the fluid film 29 is already atomized into droplets by the gaseous fluid that flows in the form of a high-velocity gaseous stream past the fluid film 29 in section L1, as is indicated in FIG. 2. However, by injecting the gaseous fluid parallel to the wall 40 of the mixing chamber into said mixing chamber and by conducting said gaseous fluid also in the second section L2 of the mixing chamber at a flat angle relative to the wall of the mixing chamber, only a minimal pressure loss occurs in the inventive two-substance nozzle. Surprisingly, it has been found that the inventive two-substance nozzle can already be operated at gaseous fluid pressures of less than 1 bar and can already effect a very uniform atomization of a fluid at these low pressures. The fact that the fluid is divided into partial jets 17 by means of the central pin 11 due to the kinetic energy of the fluid alone, said jets then effecting the formation of the fluid film 29, also contributes to the low energy demand of the two-substance nozzle in accordance with the invention.

Referring to the first embodiment of the inventive two-substance nozzle as shown in FIG. 2, the conical central pin 11 is provided with furrows 14 on its generatrix. These furrows act like small water spouts. They generate discrete fluid jets 17 that impinge on the inside wall 40 in its region 51 in the mixing chamber 7 of the nozzle 53 and form a fluid film 29 there as desired, while the atomization air 46 flows largely unimpeded through the gussets 19, see FIG. 3, between adjacent fluid jets 17. The expression "largely unimpeded" is to mean that only a part of the fluid jets 17 is atomized into individual droplets by the atomization air. However, because the atomization air 46 must flow past the fluid jets 17 originating from the central pin 11, the part of the atomization air that flows remote from the wall 40 of the mixing chamber is also decelerated and thus performs atomizing work. However, first and foremost, a faster core air jet is prevented from forming away from the wall 40 and from leaving the nozzle unused.

Inasmuch as the central pin 11 does not have a plane end surface but is provided with a trailing body in the form of a tadpole tail 15 having the length $L_P$, water deposits and a backflow region are prevented from forming downstream of the widening section of the central pin 11, whereby the water deposits could detach again in the form of large drops. Thus, the reverse side of the central pin 11 in accordance with the invention is configured as a trailing body in the form of a'slim tadpole tail 15 and, as a result, has the shape of a double cone, whereby the length of the widening first cone that is provided with the furrows 14 is substantially shorter and amounts to only approximately one fourth of the length of the trailing body. Furthermore, the form of the flow cross-section in section L1 into the mixing chamber is configured so as to be strongly convergent overall, so that also the tadpole tail 15 is subject to a high shearing stress due to the air flow. Thus, the already small amounts of fluid that are able to reach this section on the tadpole tail 15 are also drawn into thin fluid films that subsequently disintegrate into small droplets.

Figure 4:
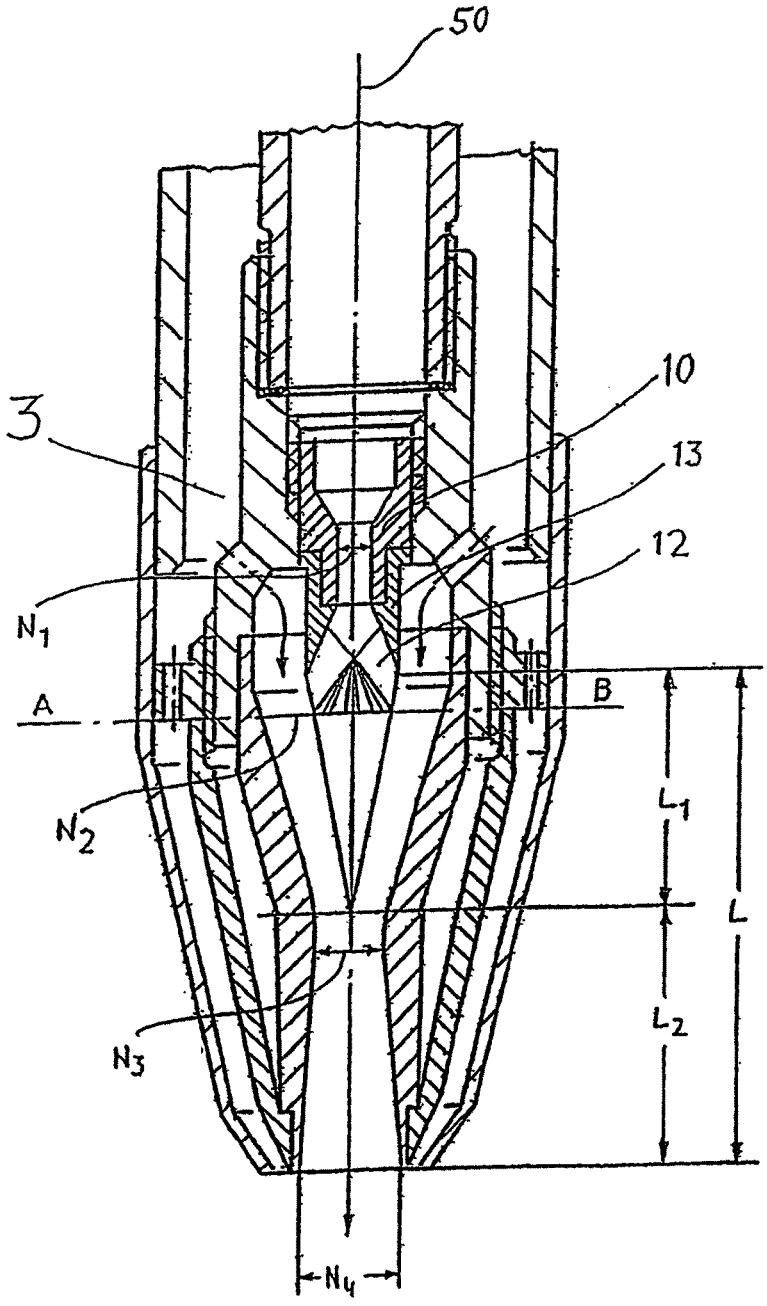
FIG. 4 is a longitudinal section of an inventive two-substance nozzle in accordance with a second embodiment, whereby the central pin is centered and fastened via radial fins and a ring on the fluid nozzle.

The central pin 11 may display very different shapes. Instead of a pointed cone as shown in FIG. 4, it is also possible to use rounded shapes. Furthermore, the furrows 14 need not strictly extend on the cone generatrices but may also be inclined thereto, so that the fluid jets 17 display a peripheral component.

One important aspect of the invention is that, whenever the entire fluid stream 39 is transferred to the region 51 of the inside wall 40 in the mixing chamber 7, there again is no optimal fluid distribution over the nozzle cross-section in the embodiment of an inventive two-substance nozzle as shown in FIG. 4. Then, a considerably larger percentage of pressurized air that is used for atomization will pass the mixing chamber sections L1 and L2 close to the central axis 50 of the nozzle, because said air is not decelerated there by the flow resistance of the collective drops in this case. Too large an air stream then passes the nozzle close to the central axis 50, without performing the intended atomization function. This results in an unnecessarily high energy consumption of the nozzle. In accordance with the invention, it has been successful to transfer just enough fluid into the fluid film 29 on the wall 40 for the freely flying droplets to apply a sufficiently high decelerating resistance on the air flow. Then the air cannot tunnel through the mixing chamber sections L1 and L2 of the mixing chamber of the nozzle 45 close to the central axis 50 without performing work, and high flow rates also occur close to the surface of the fluid film 29 in the mixing chamber wall 40. High flow rates of the pressurized air close to the film surface lead to high shearing forces on the fluid film. Consequently, the film thickness is reduced, and the droplets formed of the fluid film 29 at the nozzle orifice 48 remain correspondingly small.

Therefore, the invention provides that the furrows 14 on the surface of the central pin 11 be dimensioned in such a manner that not the total fluid stream 39 is converted into discrete fluid jets 17. Rather, between the massive fluid jets 17, thin fluid lamellae 18 are formed, said fluid lamellae opposing the atomizing air with only minimal flow resistance and disintegrating into droplets that are carried along by the pressurized air before they are able to reach the wall 40 in the mixing chamber. As a result of the fact that the pressurized air must accelerate these droplets, it cannot break through into the mixing chamber near the axis, without being hindered. Consequently, the droplet jet 31 forming downstream of the nozzle orifice 48 rather represents a solid conical jet. Without the measure described here, a hollow conical jet would be formed, at least at low fluid throughput of the nozzle.

The film surface becomes instable with high fluid throughputs and with a correspondingly high fluid flow in the fluid film 29 on the wall 40 in the mixing chamber. When the inventor investigated the stability limits of the fluid film, it was found that the instability of a fluid film surface is linked with the occurrence of rolling waves under the influence of a high-velocity air flow. These rolling waves have air inclusions as are also known from rolling waves on the ocean surface. If the air inclusions reach the surface of the film surface, the water-shrouded air bubbles burst. In this way, relatively small droplets form. Furthermore, the droplets rise relatively steeply to the film surface. Consequently, the fluid droplets are transported toward the central axis 50 in the mixing chamber. Up to a certain degree, this is desired for two reasons:

- The air flow close to the central axis 50 of the nozzle is slowed, because said air flow must perform an acceleration function at these droplets;
- The fluid film 29 on the wall 40 loses part of its fluid stream before reaching the nozzle orifice 48. Consequently, the density of energy required at the nozzle orifice 48 for atomizing the fluid film is reduced. This results in a low pressurized air consumption for the annular gap secondary atomization at the nozzle orifice. This, too, is in the interest of a reduced energy consumption for atomization.

In addition to the form of the furrows 14 on the surface of the central pin, the shape of the region 51 of the wall 40 in the region of impingement of the discrete fluid jets 17 also strongly influences the fluid part that is transported in the fluid film 29 on the wall or by the collection of exposed droplets. With a very flat impingement angle $\alpha$ of the fluid jets 17, said angle is almost fully reflected. Then, again, a high droplet number density close to the central axis 50 of the nozzle is attained and, thus, an inadequate droplet disintegration. At a very steep impingement angle $\alpha$, the impinging fluid jet 17 bursts and the fluid transfer into the fluid film 29 on the wall is inadequate in this case as well. The optimal angle ranges are a function not only of the flow conditions but also of the substance conditions of the fluid. Therefore, a limiting of advantageous angular ranges is hardly possible. With regard to the angle $\alpha$ between the wall tangent in the impingement region of the fluid jets 17 in the region 51 of the wall 40 and the wall tangent at the central pin 11, a range of approximately 20° to 70° is provided.

Also, the advantageous angles $\beta$ of the central pin in the first, expanding region and in the region of maximum diameter $D_P$ of the central pin 11 vary within a wide range, depending on the boundary conditions. A range of approximately 30° to 90° is advantageous for $\beta$. The pin diameter $D_P$ must be viewed in relation to the diameter of the fluid entry $D_{LN1}$ ("L" for liquid and "N" for narrow). The ratio $D_P/D_{LN1}$ should be within a range of two to five.

Also, the cross-sections $N_2$ (N for "narrow" on the annular gap 20 between the pin edge 44 and the mixing chamber wall 51) and $N_3$ (narrow point in the mixing chamber downstream of the tail end of the central pin 11) cannot be freely selected. In order to attain a particularly fine droplet spectrum, the objective will be in many cases to achieve the velocity of sound for the two-phase flow at the narrow point $N_3$. The flow rate of the air should not be too high at the narrow point $N_2$ at the maximum diameter of the central pin 11, because then the fluid leaving the pin edge 44 cannot break through in the region 51 of the wall 40 in the mixing chamber 7, so that there will be no film formation. Also in this instance, the dimensioning rules are highly complex. According to experimental investigations, the ratio of the cross-sections $N_2/N_3$ may be within a range of 1 to 5.

Likewise, the ratio of the cross-sections $N_4/N_3$ ($N_3$: narrow point of the Laval nozzle; $N_4$: cross-section of nozzle outlet) cannot be freely selected. One must understand that the pressurized air experiences a high loss of pressure in the course of acceleration and atomization of the droplets. Consequently, the density of the pressurized air is reduced on the way through the nozzle. And, with an expanded cross-section in the direction of flow, it is thus possible—even at flows below the velocity of sound—for an acceleration of the gaseous phase to occur. Also in this instance, only guide values can be stated. Depending on the basic concept of the nozzle (overly critical pressure conditions or low-pressure atomization), a cross-section ratio within the range of $N_4/N_3$=1 to 3 is advantageous.

Regarding data from cross-section measurements, dimensioning rules for the degree of slimness of the essential nozzle sections are difficult. The curvature of the mixing chamber wall at the narrow point $N_3$ must not be severe, because the fluid film 29 should not—beyond a reasonable measure—detach here from the wall 40 due to inertial forces. Also, a certain moving length is required in order to atomize droplets in free flight. The following dimensioning ranges are to provide guide values:

Total length L with respect to the diameter at the nozzle outlet $N_4$: $L/N_4$=3 to 10;

Length $L_1$ of the section between the narrow points $N_2$ and $N_3$, with respect to the total length L: $L_1/L$=0.2 to 1.0;

Length $L_2$ of the section between the narrow points $N_3$ and $N_4$, with respect to the total length L: $L_2/L$=0.1 to 0.8.

One very important aspect is also the constructive embodiment of the central pin 11. The pin must be installed precisely centered in relation to the entering fluid jet 39. Also, it must be possible to manufacture the pin of a wear-resistant material such as, e.g., hard metal or silicon carbide. FIG. 2 and FIG. 4 show a suggestion for a solution, whereby the fluid is injected, via a separate small fluid nozzle 10, into the mixing chamber of the two-substance nozzle. In accordance with FIG. 2, the pin can be centered by means of strips 106 relative to the mixing chamber wall 51. Advantageously, the central pin is connected to a ring via strips, said ring being connected to the nozzle housing on the mixing chamber wall.

FIG. 4 shows another centering method. In this case, the central pin 11 is connected—via three strips 12 or fins—to a cylindrical holding ring 13 that is attached to the fluid nozzle 10 by applying pressure. The design of the nozzle orifice 48 and the annular gap secondary atomization will not be discussed in detail herein; regarding this, reference is made to the international patent application WO 2007/098865 A1, whose disclosure has herewith been incorporated in the present application.

Specifically, this international patent application states that the annular gap nozzle consists of several secondary air jets that are arranged in the shape of a ring, said secondary air nozzles not only being inclined toward a central longitudinal axis of the nozzle, but, in addition, also being inclined in the same circumferential direction. The central axes of these secondary air nozzles then form the generatrix of a single-shell hyperboloid, and the out-flowing annular gap air is imparted with a twist. The individual secondary air nozzles can be configured as bores; however, it is also advantageous to configure these secondary air nozzles as recesses between components. For example, a conically sloped end of the nozzle housing is provided with recesses in the manner of a conical gear with helical toothing, said recesses then being located at a small distance from the inside wall of an annular gap nozzle.

The mixing chamber has a total length L, because an admixing of droplets detaching from the film surface occurs in the air flow not only in the convergent section $L_1$ but also in the divergent section $L_2$. This section $L_2$, which occasionally is referred to as the discharge section of the nozzle, thus also belongs to the mixing chamber of the nozzle. The droplets are also still mixed and generated downstream and outside the mixing chamber when the fluid lamellae are drawn out at the nozzle orifice and atomized. A mixing region of the nozzles in accordance with the invention thus also comprises the mixing chamber and, in addition, a region downstream of the nozzle orifice.

Figure 5:
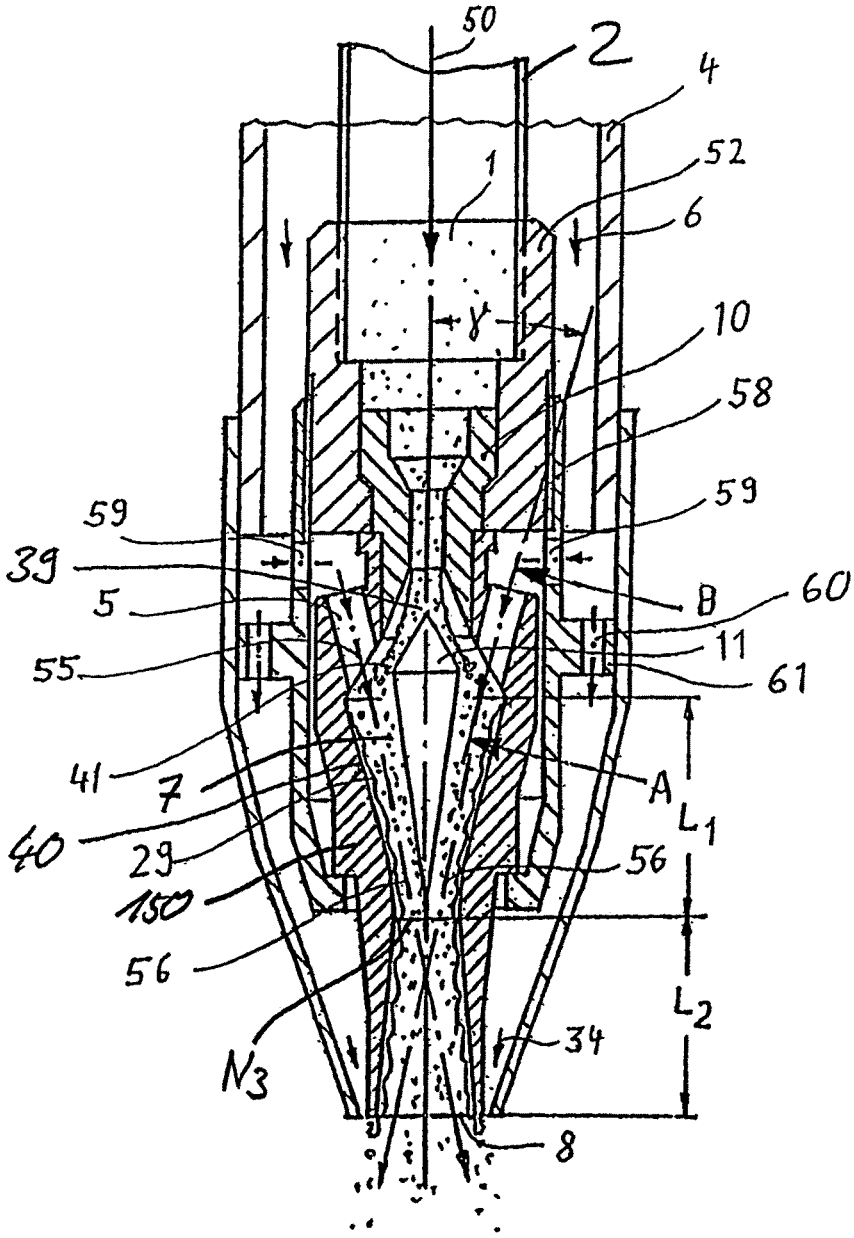
FIG. 5 is a longitudinal section of an inventive two-substance nozzle in accordance with a third embodiment with a central pin.

The sectional view of FIG. 5 shows another preferred embodiment of an inventive two-substance nozzle, whereby a central pin 11 is—again—not shown. A nozzle housing 150 that defines the wall of the mixing chamber 7 is a different constructive embodiment compared with the nozzles shown in FIG. 2 and FIG. 4 as regards the screw connection of the nozzle housing 150 with a transition part 52 to a central lance pipe 2. Indeed, this is of subordinate importance for the function of the nozzle; however, this requires the insertion of air passage bores 59 in a union nut 58 that holds the nozzle housing 150 on the transition part 52. The cross-sections of these air passage bores 59 for the pressurized air must be dimensioned in such a manner that no relevant loss of pressure occurs here. In the interest of low energy consumption of the two-substance nozzle in accordance with the invention, the loss of pressure should—if at all possible—occur only in conjunction with the finest possible atomization of the droplets.

In the embodiments in accordance with FIGS. 2, 3 and 4, an advantageous division of the fluid stream into a wall-bound fluid film as well as into freely flying droplets is achieved only in that the fluid jet entering the mixing chamber has been provided with nominal interruption points. These nominal interruption points or regions of reduced thickness are generated by furrows on the surface of the central pin; however, such nominal interruption sites may also be generated due to a special configuration of the fluid nozzle at the entry into the mixing chamber, as will be explained hereinafter with reference to FIGS. 7 and 8. If, however, the air inlet bores 5 are moved close enough to the fluid jet 39 entering the mixing chamber 7, said fluid jet splitting at an unfurrowed central pin into a uniform fluid umbrella 41, and if the injection velocity of the air jets 55 is sufficiently increased here, the air jets 55 tear furrows into the fluid umbrella 41. The fluid that is torn or plowed out of the fluid umbrella 41 by the pressurized air jets 55 is atomized into fine droplets by the air. In contrast, in the comparatively quiet zones between adjacent pressurized air jets 55, sections of the fluid umbrella 41 reach the wall in the mixing chamber and generate a fluid film 29 there, as is characteristic of a prefilming nozzle and, in particular, of a two-substance nozzle in accordance with the invention.

Figure 6:
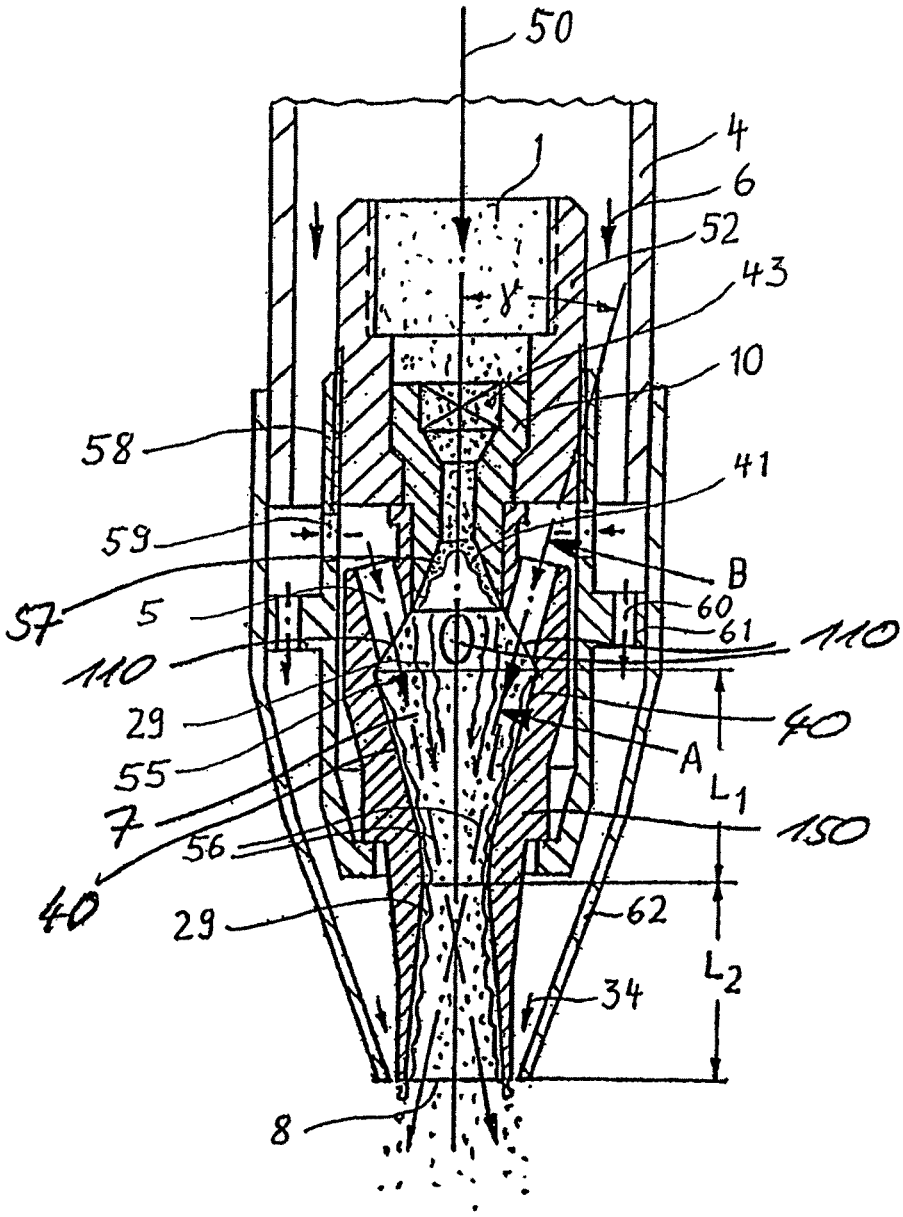
FIG. 6 is a longitudinal section of an inventive two-substance nozzle in accordance with a fourth embodiment without a central pin.
Figure 9:
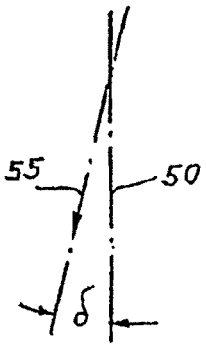
FIG. 9 is a schematic view A-B in FIG. 5 and FIG. 6 in order to illustrate the twist component of air conduction in an inventive nozzle.
Figure 10:
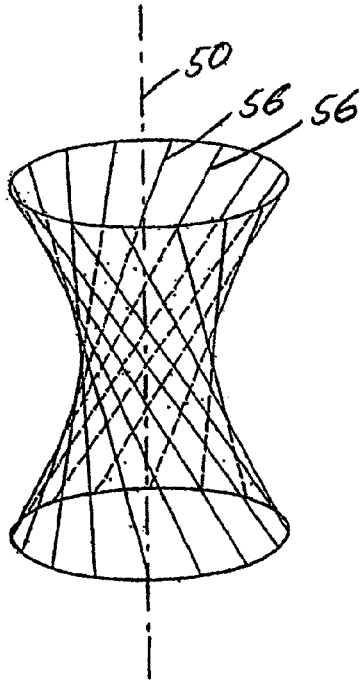
FIG. 10 is another schematic view to illustrate the twist component in the mixing chamber.

A schematic view AB of FIGS. 5 and 6 can be found in FIG. 9 to illustrate the alignment of the central axes of the inlet openings relative to the central longitudinal axis 50 of the nozzle. The air jets 55 streaming into the mixing chamber 7 are not only inclined at an angle $\gamma$ relative to the central longitudinal axis, see FIG. 5 and FIG. 6, but, in addition, comprise a co-rotating peripheral component, as is expressed in FIG. 9 by the angle $\delta$ between the air jets 55 and the central longitudinal axis 50. In this configuration, the individual air jets 55 that are loaded with droplets in passing the mixing chamber never intersect the central longitudinal axis 50 of the nozzle. Preferably, the angle $\gamma$ is within a range of from 10° to 30°, and the angle $\delta$ within a range of 5° to 15°. The pressurized air jets 55 loaded with droplets pass through the mixing chamber on approximately straight lines 56; see FIG. 5 and FIG. 6. The two-phase flow in the mixing chamber is twisted with respect to the central longitudinal axis 50. The straight lines 56 form the generatrices of the single-shell hyperboloid, as is schematically shown in FIG. 10.

As a result of this, three features are achieved:

Undesirably large drops are hurled against the inside wall of the nozzle or against the mixing chamber wall 40 due to inertial forces forming the fluid film 29 on said walls, said fluid film being disintegrated into small droplets by annular gap secondary atomization at the nozzle orifice;

The twisted two-substance jet exiting from the nozzle forms a larger jet opening angle. This effect can even be considerably intensified by twisting the annular gap air 34 in the same direction;

If the individual air jets were directed at the main axis of the nozzle, air separation effects would inevitably occur. The air could follow the channel contour at the narrow point $N_3$, whereas—due to mass inertia—the droplets would be driven toward the main axis of the nozzle or the central longitudinal axis 50. This would result in a massive central droplet jet. In such a massive central droplet jet, it would even be possible—in the droplet jet outside the nozzle—for an agglomeration of droplets to occur, so that relatively large drops would be formed, thus decisively impairing the atomization quality. Such air separation effects can be avoided with the embodiment in accordance with the invention.

The illustration as in FIG. 6 shows another preferred embodiment of the invention, in which the central pin has been omitted. Instead, upstream, a twist generator 43 is installed in the mixing chamber 7 at a suitable point in a fluid nozzle 10. Referring to the illustrated embodiment, the twist generator 43 is provided upstream of a taper of the fluid nozzle 10, said taper having the form of a truncated cone, that then terminates in a cylindrical region having a constant diameter that, then, again, opens into a region having the shape of a truncated cone, said region being adjoined by the mixing chamber 7. The twist generator 43 is constructed in such a manner that it presents almost no cross-sectional barrier; this can be achieved, for example, by a spirally extending furrow structure on the wall of the fluid nozzle in the region of the twist generator 43. Due to the effect of the twist, a goblet-shaped widening 57 of the fluid nozzle 10 of a wall-bound fluid film 41 is formed. Said latter fluid film also detaches in the form of a fluid umbrella in the regions of the first air inlet openings 110, through which pressurized jets 55 enter into the mixing chamber 7. The pressurized air jets 55 tear furrows into the fluid umbrella 41 and atomize the fluid that is being pulled along. Between adjacent pressurized air jets 55, i.e., between adjacent air inlet openings 110, the fluid umbrella 41 may reach the mixing chamber wall 40 and generate here the desired fluid film 29 that is atomized at the nozzle orifice 8 with the assistance of the annular gap air 34 to form small droplets.

In a manner known per se, the annular gap air 34 can be supplied to the annular gap via a separate annular space. This is advisable, in particular considering the aspect of energy consumption, when the pressure of the annular gap air is significantly lower than the pressure of the pressurized air for main atomizing which is injected into the bores 5 having the inlet openings 110. In the embodiment of the inventive two-substance nozzle shown in FIG. 6, however, the loss of pressure in the pressurized air for main atomization that is being conducted through the mixing chamber is relatively low, so that the annular gap air 34 in the nozzle can be branched off the pressurized air for main atomization. This is accomplished via bores 60 in a centering ring 61 on the union nut 58 with which the nozzle housing 150 is fastened to the transition part 52.

The two-substance nozzles in accordance with the invention are suitable for the atomization of solids-containing fluids; of course, they can also be used for the atomization of solids-free fluids.

Figure 7:
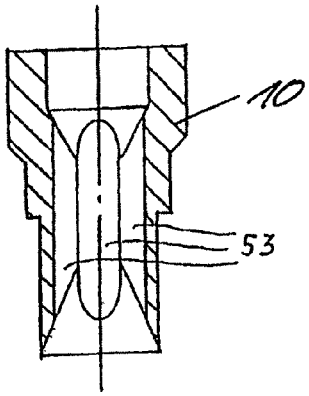
FIG. 7 is a longitudinal section of a fluid nozzle for injecting fluid to be atomized into the mixing chamber of an inventive two-substance nozzle in accordance with a fifth embodiment.
Figure 8:
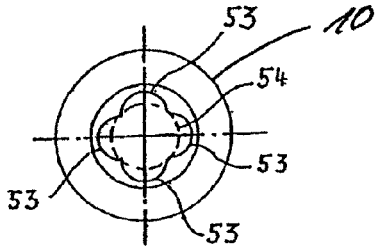
FIG. 8 is a cross-section of the fluid nozzle of FIG. 7.

FIGS. 7 and 8 show another possible configuration of the fluid jet 10 in the inventive two-substance nozzle in accordance with FIGS. 5 and 6. Instead of dividing the massive fluid jet, which enters into the mixing chamber, into individual jets by means of furrows on the in-flow side of a central pin, the fluid nozzle 10 in accordance with FIG. 7 has furrows 53 displaying a generically related effect and being provided on the wall of the fluid nozzle 10 in the supply region toward the mixing chamber. In FIG. 7, a furrow structure having the shape of a four-leaf clover is provided, for example. Because of the furrows 53 in the wall of the fluid nozzle 10, which are also readily obvious in the sectional view in accordance with FIG. 8, the fluid jet—after leaving the fluid nozzle 10—shows notches that positively affect the jet disintegration. A decisive advantage of such a configuration of the fluid nozzle 10 consists in that the cross-section of the fluid supply is not noticeably constrained. This is of importance because the fluid to be atomized may be loaded with solid-substance platelets that could lead to a diversion of the fluid supply to the mixing chamber. Although in the geometric configuration of a four-leaf clover the diameter of the inside circle 54 indicated in dashed lines in FIG. 8 is slightly smaller than the inside diameter of a supply having cylindrical form, the size of maximum cross-section is slightly larger. And, because the solid platelets, as a rule, are not arranged transversely with respect to the main direction of flow, relatively large platelets may pass edgewise through the fluid nozzle 10 in accordance with FIG. 7 and FIG. 8.

Within the scope of the invention, different furrow structures, for example corresponding to a three-leaf clover, may be provided on the wall of the fluid nozzle 10. In particular, there is also the option of configuring the furrows not in a manner coaxial with respect to the nozzle axis but to provide a peripheral component. In this case, a twisting of the fluid entering into the mixing chamber is also achieved, so that the fluid nozzle 10 may take over the function of a twist generator at the same time.

Figure 11:
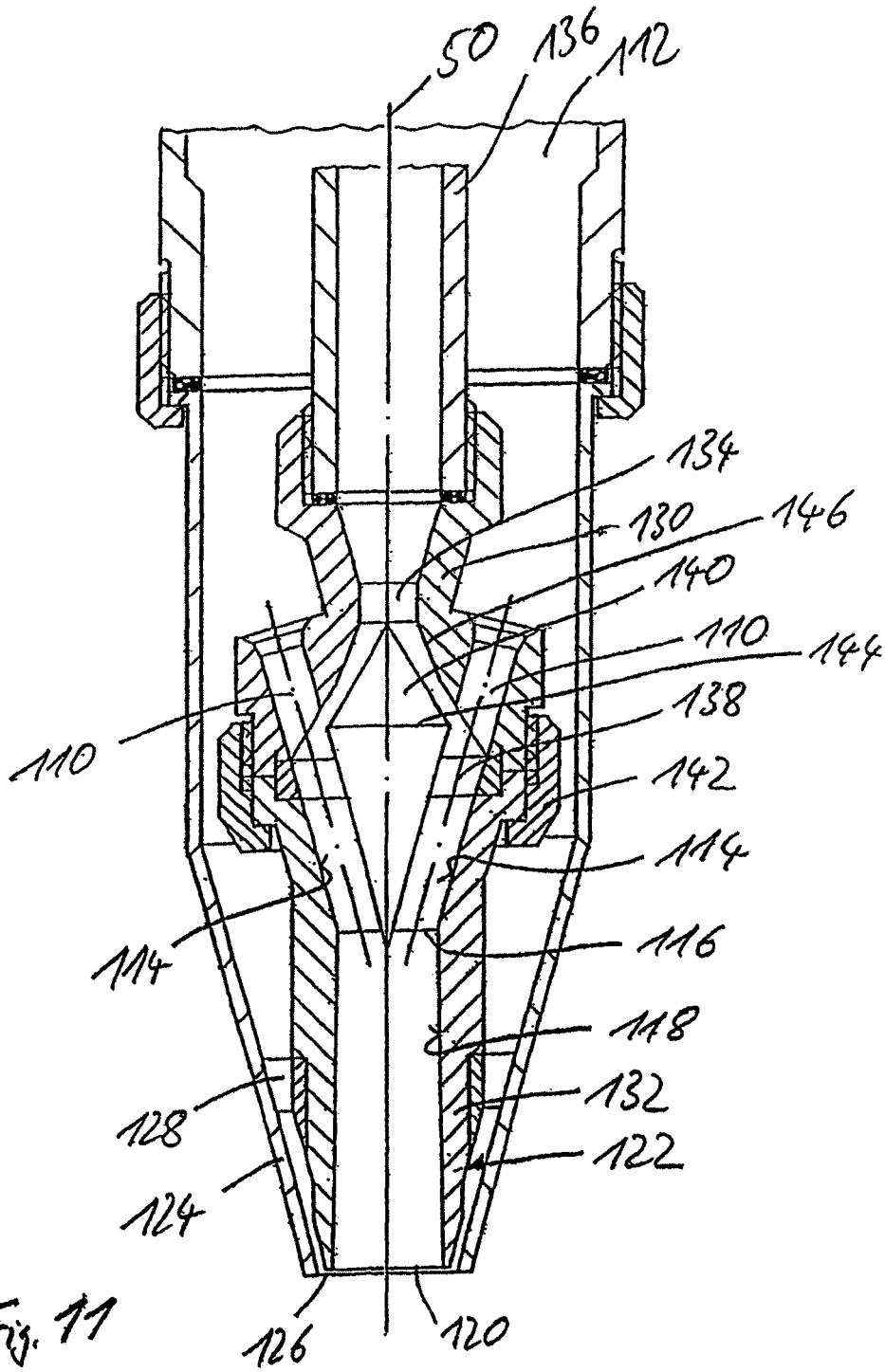
FIG. 11 is a longitudinal section of an inventive two-substance nozzle in accordance with a sixth embodiment of the invention.
Figure 12:
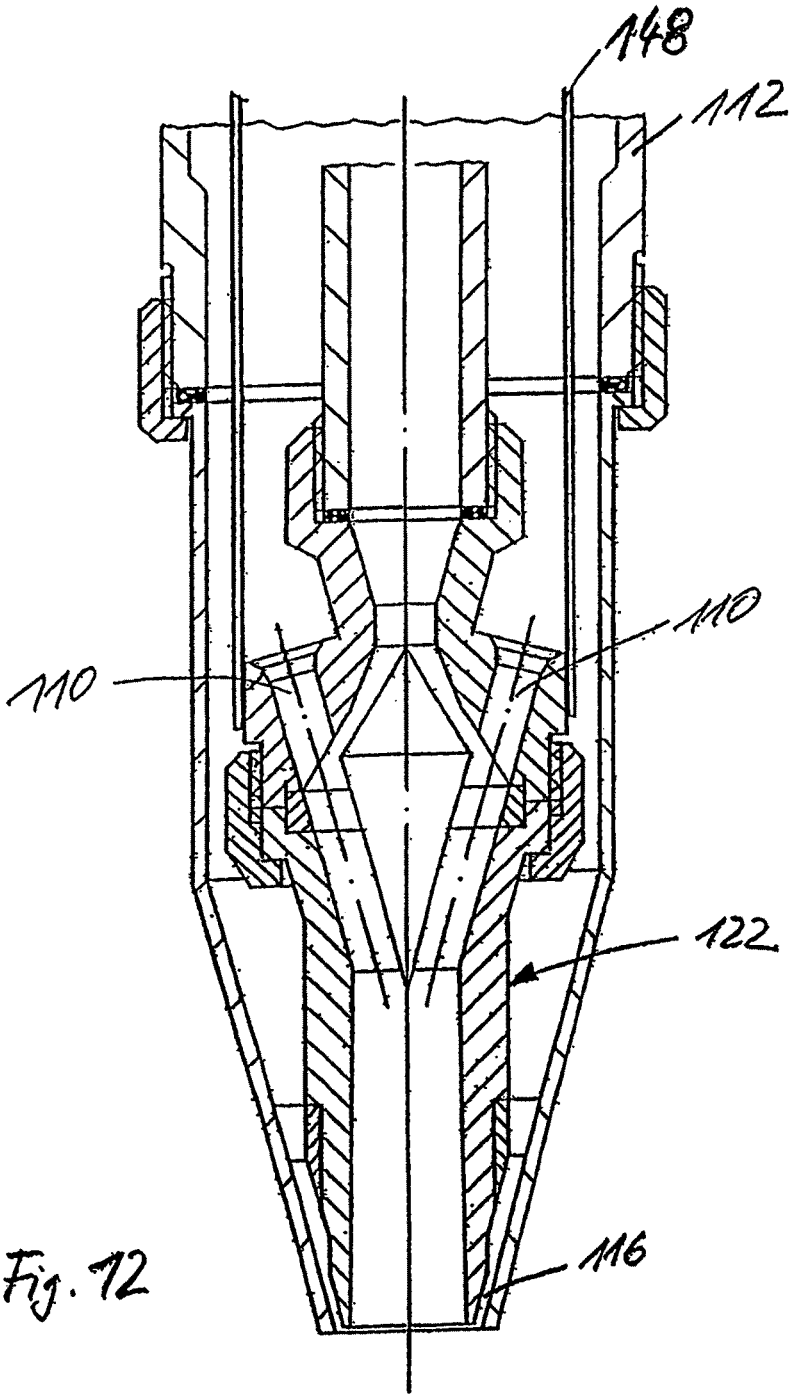
FIG. 12 is a longitudinal section of an inventive two-substance nozzle in accordance with a seventh embodiment of the invention.
Figure 13:
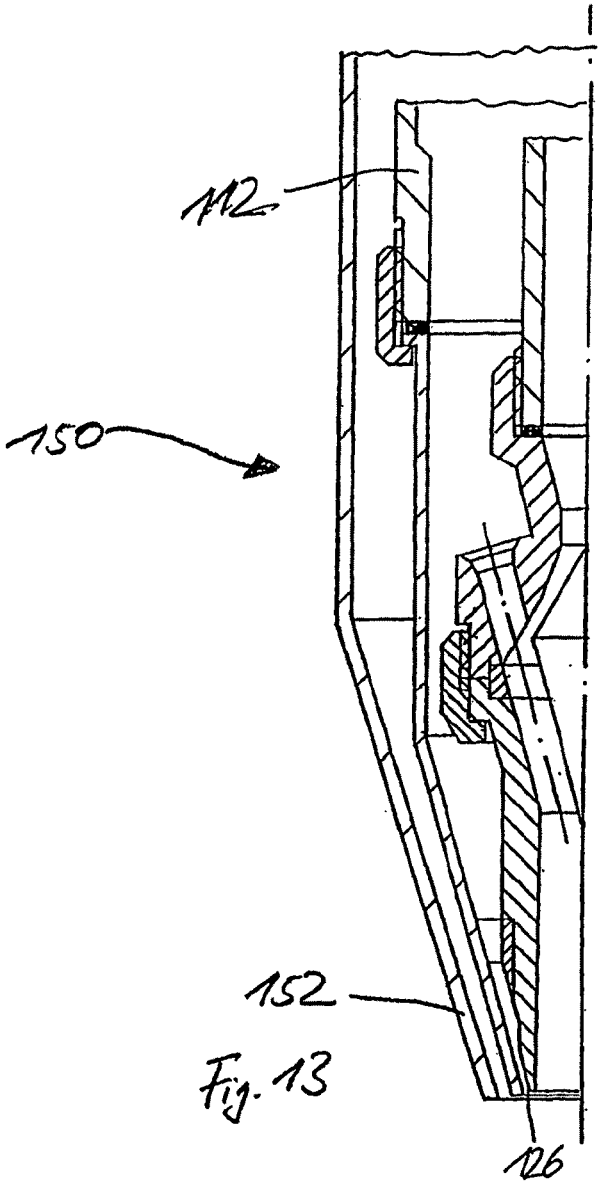
FIG. 13 is a longitudinal section of an inventive two-substance nozzle in accordance with an eighth embodiment of the invention with an additional veil-of-air nozzle.

FIG. 11 shows another embodiment of the two-substance nozzle in accordance with the invention. In this case, it is an essential issue that the inlet openings 110 or their central axes are aligned so as to be skewed relative to the central longitudinal axis 50 of the nozzle. If the central axes of the inlet openings 110 are thus lengthened and rotated about the central longitudinal axis 50, the lateral surface of an imagined rotation hyperboloid is the result, said hyperboloid surrounding the central longitudinal axis 50; see also FIG. 10. As a result of such an arrangement of the inlet openings 110 it is possible to put the inflowing gaseous fluid into rotation, as a result of which the generation of small droplets is promoted, as has already been explained. This embodiment offers the advantage that the bore ring in the union nut 58, see FIG. 6, can be omitted. Considering the aspect of energy consumption, the nozzles in accordance with FIG. 11 and the generically related nozzles in accordance with FIG. 12 and FIG. 13 are able to achieve the best results.

Despite the skewed arrangement of the central axes of the inlet openings 110 relative to the central longitudinal axis 50 of the nozzle, it is obvious from FIG. 11 that the gaseous fluid is introduced by a supply pipe 112 via several inlet openings 110 parallel to a wall 114 in a mixing chamber. In the nozzle shown in FIG. 11, the mixing chamber has the form of a hollow double cone. The wall 114 has the form of a hollow truncated cone and extends up to a narrow point 116. Starting from the narrow point 116, the mixing chamber widens slightly, so that an internal wall 118 of the mixing chamber in this second section downstream of the narrow point 116 has again the form of a hollow truncated cone but with a very small opening angle. The mixing chamber terminates at a nozzle outlet opening 120 that, at the same time, forms the downstream end of a nozzle housing 122. The nozzle outlet opening 120 as well as the entire nozzle housing 122 are surrounded by an annular gap pipe 124 that—viewed in the direction of flow—terminates just after the nozzle outlet opening 120 at an annular gap opening 126. Defined between the annular gap opening 126 and the nozzle outlet opening 120 is an annular gap through which annular gap air exits, said annular gap air also being supplied via the supply pipe 112 and flowing inside the annular gap air pipe 124 past the nozzle housing 122.

In order to ensure the most precise adjustment of the annular gap air width possible between the inside of the annular gap air pipe 124 and the outside of the nozzle housing 122 and to impart the annular gap air with a twist at the same time, a twist body 128 is interposed—at half the distance between the narrow point 116 and the nozzle outlet opening 120—between the nozzle housing 122 and the annular gap air pipe 124. On the one hand, the twist body 128 abuts against the nozzle housing 122 and, on the other hand, against the annular gap air pipe 124, and thus ensures a highly precise adjustment of the annular gap width. In addition, as already mentioned, a twist is applied by the twist body 128 to the annular gap air in the annular gap air pipe 124. The annular gap width can be adjusted more precisely by means of the twist body 128, the closer said twist body is located near the annular gap opening 126. For example, the twist body 128 may be configured as a disk that is provided with obliquely cut grooves extending from the outside circumference.

Figure 14:
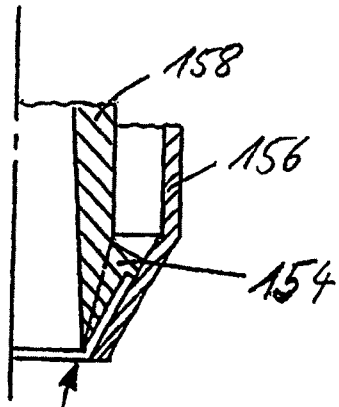
FIG. 14 is a longitudinal section of the orifice region of an inventive two-substance nozzle in accordance with a ninth embodiment of the invention.

FIG. 14 shows an arrangement of a twist generator 154 for generating the twist and for centering an annular gap air pipe 156 close to the nozzle orifice.

The nozzle housing 122 is made of two parts and comprises an upstream section 130, as well as a downstream section 132. The upstream section 130 has the inlet opening 134 for the fluid to be atomized and is provided—upstream of the inlet opening 134—with a connecting flange for a supply pipe 136 for the fluid that is to be atomized. Upstream of the inlet opening 134 is a convergent region; downstream of the inlet opening 134 is a divergent region that then extends up to the wall 114 of the mixing chamber. In addition, the upstream section 130 has several inlet openings 110, whereof, for example, four to eight are distributed over the circumference of the nozzle housing 122. The upstream section 130 ends at a holding strip 138 that projects into the mixing chamber and is fastened to a central pin 140 having the shape of a double cone. On at least two sides, the holding strip 138 connects the central pin 140 to the nozzle housing 122 and is specifically connected to the nozzle housing 122 at the dividing point between the upstream section 130 and the downstream section 132. The upstream section 130 and the downstream section 312 of the nozzle housing 122 are held together by means of a union nut 142. After removing the union nut, the sections 130, 132 of the nozzle housing 122 may be separated from each other, and the central pin 140 may be removed together with the strip 138 and be replaced in case of wear, for example.

By means of a differently configured central pin 140, it is possible to adapt the nozzle to different fluids that are to be atomized. For example, the central pin 140 may also consist of hard metal or ceramic.

Basically, the function of the two-substance nozzle shown in FIG. 11 is the same as has already been described with reference to FIGS. 2 and 5. In this case, the central pin 140 is provided with a smooth surface—in the region of its tip facing the inlet opening 134 for the fluid to be atomized, as well as in the region of its trailing body that also has the shape of a point of a cone. As a result of this, the central pin 140 has the shape of a double cone, whereby the tailing body is approximately more than twice as long as the tip facing the inlet opening 134. The central pin 140 extends from the downstream end of the inlet opening 134 up into the region of the narrow point 116. Under some circumstances, it is also advantageous in this case if the central pin is provided with furrows, as is shown in FIG. 3.

The trailing body of the central pin 140 is configured and arranged in such a manner that its outside wall extends parallel to the wall 114 of the first section of the mixing chamber. An annular gap width between the wall 114 and the central pin 140 in the first section of the mixing chamber, i.e., up to the narrow point 116, thus remains constant whereas a free cross-section of the mixing chamber is tapering.

During operation of the nozzle, the fluid to be atomized passes the inlet opening 134 and impinges on the tip of the central pin 140. As a result of this, the fluid to be atomized is divided—by means of the fluid's own kinetic energy—into a film flowing along the tip of the central pin 140. This film then leaves the central pin 140 at the widest point 144 of said pin, and the largest part of said film reaches the wall 114 of the mixing chamber. As a result of this, a fluid film is formed on this wall 114, said film subsequently being driven in the direction of the nozzle outlet opening 120 by the gaseous fluid that enters through the inlet openings 110. The gaseous fluid is injected through the inlet openings 110 parallel to the wall 114 and also flows parallel to the outside wall of the trailing body of the central pin 140. In the downstream section of the mixing chamber, i.e., downstream of the narrow point 116, the gaseous fluid impinges at a flat angle of approximately 10° to 15° against the wall 118 in the mixing chamber. This flat impinging angle increases the shearing stress between the gaseous fluid and the fluid film on the wall 118 and, in so doing, ensures that the fluid film is rapidly driven in the direction of the nozzle outlet opening 120.

With an appropriate velocity difference between the fluid film on the walls 114, 118 of the mixing chamber and the gaseous fluid, the fluid film displaying sufficient film thickness will be torn into droplets during its movement through the mixing chamber, as has already been previously explained with reference to the formation of rolling waves. The gas velocity, the shearing stress on the fluid film and the film thickness are decisive for this partial tearing.

Also, after leaving the central pin 140 at its widest point 144, a part of the fluid to be atomized is already disintegrated into droplets because the fluid flowing into the inlet openings 110 must pass the fluid film. In the regions that are at a greater distance from the wall 114, the gaseous fluid is also loaded with droplets, and atomization work must be performed and a deceleration occurs. The atomization work is thus viewed as the sum of the work for generating new fluid surfaces, i.e., the generation of droplets, for example of a solid jet, and/or the disintegration of large drops into small droplets, the work required for the acceleration of the droplets, as well as the work for overcoming the frictional forces between gas and fluid and between fluid and wall. Consequently, it is thus avoided that, in the second part of the mixing chamber downstream of the narrow point 116, a faster core air flow is formed, said core air flow not performing any atomizing work and being loaded or only unessentially loaded with droplets, and leaving the nozzle outlet opening 120 essentially without being utilized. Rather, with the nozzle in accordance with the invention it is possible that also the core regions of the stream are loaded with droplets in the section of the mixing chamber downstream of the narrow point 116 and do not flow faster or not substantially faster than the regions flowing close to the wall 118.

After passing the nozzle outlet opening 120, the fluid film on the wall 118 is then drawn into thin fluid lamellae that then are atomized into fine droplets by means of the gaseous fluid exiting from the mixing chamber and by means of the annular gap air.

As has already been explained, the central pin may also be provided with channels or furrows in order to generate discrete fluid jets that then impinge against the wall 114 of the mixing chamber.

It must be added that a partial disintegration of this fluid film on the walls 114, 118 does not necessarily need to begin already inside the nozzle. In the region of low fluid throughputs, the film is so thin that it could not be atomized even by a supersonic air flow inside the mixing chamber. In such a case, the entire atomization occurs only at the nozzle outlet opening 120 when the fluid film is drawn into lamellae and packed between the central atomizing air exiting from the nozzle outlet opening 120 and the annular gap air stream. The film flow is, in fact, instable only at high fluid flow rates in the fluid film on the walls 114, 118, and a partial atomization occurs already inside the mixing chamber, i.e., long before the nozzle outlet opening 120 is reached.

The nozzle outlet opening 120 is represented by the downstream end of the nozzle housing 122. In order to prevent the adhesion of fluid droplets at the face of the nozzle housing 122, this face that surrounds the nozzle outlet opening 120—the so-called front bank—is made as small as possible. In an embodiment of the nozzle housing 122 in stainless steel, the width of this annular face may be between 0.1 mm and 0.4 mm, in the case of a hard metal embodiment between 0.2 mm and 0.5 mm. Due to the minimal width of this face, the nozzle housing 122 is shock-sensitive in the region of the nozzle outlet opening 120. In order to protect the shock-sensitive front bank of the nozzle housing 122, the annular gap air pipe 124 projects slightly beyond the front bank of the nozzle housing 122 in the direction of flow. With the annular gap nozzle, the width of the face or the width of the front bank is comparatively uncritical because no fluid exits through the annular gap opening 126 and thus it is not possible for fluid droplets to deposit on the front bank of the annular gap air pipe 124. Because the annular gap air pipe projects minimally farther in the direction of flow than the nozzle housing 122, an optimal function of the two-substance nozzle can be combined with insensitivity to shock.

FIG. 12 shows another embodiment of a two-substance nozzle. Different from the two-substance nozzle shown in FIG. 11, an additional pipe 148 is provided, said pipe extending from the nozzle housing 122 into the supply pipe and, as a result of this, separating an air supply for the inlet openings 110 from the air supply for an annular gap 116. The two-substance nozzle may be operated in a special cleaning mode in that, for example, a vacuum is applied to the central supply pipe for the fluid to be atomized in order to prevent cleaning fluid that is injected through the bores 110 in the mixing chamber from exiting from the nozzle through the orifice 120. By reverse suction, the air that is not loaded with cleaning fluid and exits from the annular gap is sucked back through the mixing chamber. Should cleaning fluid be introduced in the mixing chamber through the bores 110 without reverse suction, said cleaning fluid will automatically exit through the nozzle orifice. In this case, the annular gap air that is not loaded with cleaning fluid will take over the atomizing work.

FIG. 13 is a longitudinal section of an inventive two-substance nozzle 150 in accordance with an eighth embodiment of the invention. The two-substance nozzle 150 is essentially constructed in the same manner as the two-substance nozzle shown in FIG. 11, so that only the differences with respect to the two-substance nozzle of FIG. 11 will be explained. In addition to the components of the two-substance nozzle shown in FIG. 11, the two-substance nozzle 150 in accordance with FIG. 13 is provided with a veil-of-air nozzle 152 that surrounds the annular gap nozzle with annular gap opening 126. While the air exits from the annular gap nozzle at a high velocity—approaching the velocity of sound—in order to be able to disintegrate the fluid film into fine droplets, the veil of air leaves the veil-of-air nozzle 152 at a low velocity of, e.g., approximately 50 m/s. The veil of air is disposed to thermally uncouple the outside skin of the spray lance—i.e., among other things, the outside skin of the supply pipe 112—from the cold core of the nozzle through which the fluid to be atomized is supplied. The outside skin is to be kept hot enough in order to prevent the temperature on the outside skin from dropping below the dew point of sulfuric acid or the dew point of water vapor. As a result of this, deposits on the outside skin of the spray lance and also specifically in the region of the annular gap nozzle defining the annular gap opening can be prevented. Also, corrosion on the nozzle lance can be prevented by heating the veil of air.

FIG. 14 shows a longitudinal section of the nozzle orifice of another preferred embodiment of a two-substance nozzle in accordance with the invention. In this nozzle, the annular gap nozzle is configured in a special manner in that—by means of a twist body 154—the width of the annular gap is not configured in a uniform manner when viewed over the cross-section. Rather, the twist body 154 extending from the nozzle housing 158 and abutting in sections against the annular gap air pipe 156 is provided with recesses that are comparable to a conical gear with helical toothing. As is obvious from FIG. 14, the twist body 154 is arranged close to the nozzle orifice. Due to the arrangement and the special configuration of the twist body 154, the exiting annular gap air is imparted with a twist that results in a larger jet opening angle. Thus, different from the two-substance nozzle shown in FIG. 11, the twist body 154 is displaced forward up to the nozzle orifice. Here it is important that, directly at the nozzle orifice 160, a peripheral annular gap is provided in addition to the recesses. Directly at the nozzle orifice 160, the sections between the recesses must never come into contact with the wall opposite the annular gap air pipes 156, because otherwise no annular gap secondary atomization occurs in these regions. Therefore, the regions abutting against the annular gap air pipe 156, as can be recognized in FIG. 14, are provided slightly set back of the nozzle orifice 160 counter to the outflow direction. As a result of this, it is possible to achieve precise centering of the annular gap air pipe 156 relative to the nozzle housing 158 and also a precise adjustment of the annular gap opening. Inasmuch as the sections of the central body 154, also referred to as the centering points, abut against the inside wall of the annular gap air pipe 156, the trailing flow of these centering points that may also be referred to as twist-generating interference bodies may refill again in the interference field on the way to the nozzle orifice 160 of the annular gap nozzle.

The twist body 154 may be connected to the nozzle housing 158 or even consist of one piece with the nozzle housing 158. In the embodiment of FIG. 14, the recesses—each by itself forming a secondary air nozzle—are created between components located opposite each other in the region of the nozzle orifice, namely, the nozzle housing 158 and the annular gap air pipe 156. In this manner, it is possible not only to achieve an exact centering of the annular gap air pipe and an exact adjustment of the annular gap width but to also provide an arrangement that is simply engineered and easy to manufacture.

LIST OF REFERENCE SIGNS

1 Fluid to be atomized, loaded with fine particles and larger coating platelets

2 Central lance pipe for fluid supply to the mixing chamber of the two-substance nozzle

3 Two-substance Laval nozzle

4 Lance pipe for the supply of the pressurized gas to the two-substance nozzle

5 Bores for the injection of the pressurized gas into the mixing chamber

6 Pressurized gas, in particular pressurized air

7 Mixing chamber of the two-substance nozzle, composed of a primary mixing chamber region $L_1$ and a secondary mixing chamber region $L_2$
8 Exit N4 of the two-substance nozzle 9
9 Two-substance mixture of pressurized gas and fluid droplets into the mixing chamber
10 Fluid nozzle for the injection of fluid into the mixing chamber
11 Central pin for the primary separation of fluid
12 Connecting strips between the central pin and the holding ring on the fluid inlet nozzle
13 Holding ring for the central pin on the fluid inlet nozzle
14 Furrows along the generatrices of the central pin
15 Tadpole tail of central pin having the length $L_P$
16 Fluid film on the central pin
17 Discrete fluid jets discharged from the grooves of the central pin
18 Thin fluid lamella at the narrow point $N_2$ that disintegrates into droplets
19 Perfusion gusset for pressurized air between adjacent fluid jets 17
20 Cross-section at narrow point $N_2$ between the central pin and the mixing chamber wall
21 Cross-section at narrow point $N_3$
22 Cross-section at narrow point $N_4$ or nozzle outlet cross-section
23 Largest diameter of central pin $D_P$
24 Length $L_1$ of the primary mixing chamber section
25 Length $L_2$ of the secondary mixing chamber section
26 Total length L of the mixing chamber
27 Cone angle of the central pin $\beta$
28 Angle $\alpha$ between the tangent on the central pin and the mixing chamber wall in the region of the impinging fluid jets
29 Fluid film on the mixing chamber walls
30 Droplets that detach from the fluid film on the mixing chamber wall
31 Droplet jet at entry into a secondary gaseous fluid, e.g., in flue gas
32 Annular gap nozzle
33 Annular gap with conical or star-shaped cross-section
34 Annular gap air
35 Primary pressure chamber for pressurized air supply of the two-substance nozzle
36 Pressure chamber for the portion of atomizing air that is being moved via the mixing chamber
37 Pressure chamber for the annular gap air of the cluster-head nozzle
38 Flue gas or secondary gaseous fluid into which gaseous fluid is injected
39 Fluid jet at exit of fluid nozzle 10
40 Nozzle inside wall or mixing chamber wall
41 Umbrella-shaped fluid lamella
42 Central jet of larger droplets
43 Twist body in the fluid feed line to the mixing chamber
44 Edge of the central pin
45 Larger coating platelets
46 Air flow at entry into the mixing chamber
47 Core air jet with low droplet load
48 Nozzle orifice
49 free
50 Nozzle axis, central longitudinal axis of the nozzle
51 Mixing chamber wall in the region of impingement of the water jets 17
52 Transition part from the central lance pipe 2 to the mixing chamber or to the fluid nozzle 10
53 Furrows on the wall of the central bore of the fluid nozzle 10
54 Inside circle diameter of a fluid nozzle with furrows
55 Pressurized air jets displaying high velocity
56 Straight lines to illustrate the largely straight droplet-loaded pressurized air stream in a mixing chamber
57 Goblet-shaped widening of the fluid nozzle 10 toward the mixing chamber 7
58 Union nut
59 Air passage bores in the union nut 58
60 Flow-over bores for the annular gap air
61 Centering ring for the annular gap nozzle 62 on the union nut 58
62 Annular gap nozzle
63 through 99 free
100 Inlet opening
102 Central fluid outlet
104 Nozzle housing
110 Inlet opening
112 Supply pipe
114 Wall in the mixing chamber
116 Narrow point
118 Wall in the mixing chamber
120 Nozzle outlet opening
122 Nozzle housing
124 Annular gap air pipe
126 Annular gap opening
128 Twist body
130 Upstream section of the nozzle housing
132 Downstream section of the nozzle housing
134 Inlet opening for the fluid to be atomized
136 Supply pipe for the fluid to be atomized
138 Holding strip
140 Central pin
142 Pipe for separating the annular gap air supply and the atomizing air supply
144 Widest point of the central pin 140
146 Conical widening downstream of the inlet opening 134
148 Pipe
150 Two-substance nozzle
152 Veil-of-air nozzle
154 Twist generatrix
156 Annular gap air pipe
158 Nozzle housing
160 Nozzle orifice

The invention claimed is:

1. A two-substance nozzle comprising a nozzle housing, said nozzle housing comprising at least a first fluid inlet for fluid to be atomized, a second fluid inlet for gaseous fluid, a mixing chamber, a nozzle outlet opening, an annular gap opening surrounding the nozzle outlet opening, means for generating a film of fluid to be atomized on a wall in the mixing chamber within the nozzle housing, and inlet openings injecting gaseous fluid into the mixing chamber, wherein the inlet openings and the mixing chamber are aligned and configured in a manner so as to inject the gaseous fluid substantially parallel to the wall in the mixing chamber and to move the gaseous fluid within the mixing chamber substantially parallel past the wall, wherein the means for generating a film of fluid to be atomized comprises droplet loading means in the mixing chamber for loading the gaseous fluid with fluid droplets at least in regions remote from the wall with the film of fluid, said regions not being decelerated by friction between the film of fluid and the gaseous fluid, and wherein the means for generating a film of fluid to be atomized comprise a central pin, whereby one of the inlet openings for the fluid to be atomized is directed at a tip of the central pin, and the central pin initially widens in a cone configuration starting at the tip.

2. The two-substance nozzle as in claim 1, wherein the inlet openings for injecting gaseous fluid into the mixing chamber are aligned at an angle between 0 degrees and 30 degrees relative to the wall in a first third of a length of the mixing chamber.

3. The two-substance nozzle as in claim 1, wherein central axes of the inlet openings for the gaseous fluid are inclined relative to a central longitudinal axis of the mixing chamber in such a manner that the central axes of the inlet openings move toward the central longitudinal axis of the mixing chamber as viewed in a direction of flow of the gaseous fluid.

4. The two-substance nozzle as in claim 1, wherein the central pin is configured to divide the fluid to be atomized by means of flow energy of the fluid to be atomized into partial streams.

5. The two-substance nozzle as in claim 1, wherein the central pin is provided, in a region of a flow approach side for the fluid to be atomized, with at least two channels or furrows that extend from the tip of the central pin to a point of largest diameter of the central pin.

6. The two-substance nozzle as in claim 5, wherein the channels or furrows extend on generatrices of the central pin or are inclined with respect thereto.

7. The two-substance nozzle as in claim 1, wherein the central pin, when viewed in a direction of flow, has a tapering trailing body downstream of a region of maximum diameter.

8. The two-substance nozzle as in claim 1, wherein the central pin has the shape of a double cone.

9. The two-substance nozzle as in claim 7, wherein the wall in the mixing chamber is arranged so as to be substantially parallel to the tapering trailing body of the central pin.

10. The two-substance nozzle as in claim 7, wherein, viewed in the direction of flow, a free flow cross-section of the mixing chamber decreases in a course of the trailing body of the central pin.

11. The two-substance nozzle as in claim 7, wherein central axes of the inlet openings for the gaseous fluid into the mixing chamber are arranged so as to be substantially parallel to an outside wall of the trailing body of the central pin.

12. The two-substance nozzle as in claim 8, wherein a region with minimum cross-section of the mixing chamber is arranged on a level of a downstream tip of the double cone.

13. The two-substance nozzle as in claim 1, wherein the mixing chamber tapers in a form of a first hollow truncated cone and widens again, starting from a region of minimum cross-section in a form of a second hollow truncated cone, whereby central axes of the inlet openings for the gaseous fluid are aligned in the mixing chamber parallel to the wall of the mixing chamber in the second hollow truncated cone.

14. The two-substance nozzle as in claim 1, wherein the inlet openings for the fluid to be atomized are directed against a tip of the central pin, and the central pin is connected, via at least two radially extending strips, with the nozzle housing defining the wall of the mixing chamber.

15. A cluster nozzle for atomization of fluids including at least two two-substance nozzles as claimed in claim 1.

* * * * *